US005249738A

United States Patent [19]

Werth

[11] Patent Number: 5,249,738

[45] Date of Patent: Oct. 5, 1993

[54] DETACHABLE MULTI-UNIT PACKAGE

[75] Inventor: Elmer D. Werth, Arvada, Colo.

[73] Assignee: Container Systems, Inc., Arvada, Colo.

[21] Appl. No.: 629,251

[22] Filed: Dec. 18, 1990

Related U.S. Application Data

[63] Continuation-in-part of Ser. No. 538,834, Jun. 15, 1990, abandoned, which is a continuation-in-part of Ser. No. 510,173, Apr. 17, 1990, abandoned.

[51] Int. Cl.[5] ..... B65D 5/54

[52] U.S. Cl. ..... 229/235; 53/398; 206/192; 206/194; 229/40; 229/240

[58] Field of Search ..... 229/120.29, 40, 235, 229/240, 243, 244; 206/140, 158, 192, 194, 434; 53/398, 48.8, 48.9

[56] References Cited

U.S. PATENT DOCUMENTS

| | | | |
|---|---|---|---|
| 2,758,777 | 8/1956 | Dixon . | |
| 3,092,300 | 6/1963 | Johnson | 229/120.29 |
| 3,680,765 | 8/1972 | Harrelson | 206/140 |
| 3,692,228 | 9/1972 | Spiegel | 206/194 |
| 3,759,378 | 9/1973 | Werth | 206/65 |
| 3,942,631 | 3/1976 | Sutherland et al. | 206/44.12 |
| 3,948,388 | 4/1976 | Mueller | 206/194 |
| 4,130,202 | 12/1978 | Champlin et al. | 206/434 |
| 4,164,286 | 8/1979 | Sutherland | 229/40 |
| 4,342,417 | 8/1982 | Forbes, Jr. | 229/120.29 |
| 4,415,082 | 11/1983 | Martin | 206/431 |
| 4,438,843 | 3/1984 | Graser | 206/148 |
| 4,489,880 | 12/1984 | Calvert | 206/434 |
| 4,566,593 | 1/1986 | Muller | 206/611 |
| 4,703,847 | 11/1987 | Oliff | 229/40 |
| 4,821,874 | 4/1989 | Uhlig | 206/434 |
| 4,875,585 | 10/1989 | Kadleck et al. | 206/434 |
| 4,919,269 | 4/1990 | Wright et al. | 206/602 |
| 4,932,531 | 6/1990 | Bakx | 229/40 |

FOREIGN PATENT DOCUMENTS 0029365 5/1981 European Pat. Off. .

*Primary Examiner*—Allan N. Shoap
*Assistant Examiner*—Christopher J. McDonald
*Attorney, Agent, or Firm*—James R. Young

[57] ABSTRACT

Disclosed is a package formed from a one-piece wrapper, typically made of carrier board, that is folded around twenty-four cans or bottles including a top and bottom of the package having cuts or perforations that partially separate the package into two twelve-packs; each side of the package having at least one tear-strip aligned with the cuts or perforations that will complete the separation into two twelve-packs; and the top of the package having a second pair of tear-strips which will allow the two twelve-packs to be separated into four six-packs. The wrapper can be folded in such a manner that the two six-packs of each of the two twelve-packs is separated by a center divider in the wrapper. This divider has a perforated top end which is aligned with the tear-strips. The two sides of the divider are held together by an adhesive which allows the six-packs to be separated. The combination of the tear-strips and the adhesive hold the container into a twenty four-pack, while easily allowing it to be divided into two twelve-packs, or four six-packs.

20 Claims, 10 Drawing Sheets

DETACHABLE MULTI-UNIT PACKAGE

This application is a continuation-in-part of Application Ser. No. 07/538,834 filed Jun. 15, 1990, now abandoned, entitled "Detachable Multi-Unit Package", which is a continuation-in-part of Application Ser. No. 07/510,173 filed Apr. 17, 1990, now abandoned, entitled "Detachable Multi-Unit Package".

BACKGROUND OF THE INVENTION

This invention relates to packaging a plurality of containers and more particularly to a package that can be separated into a plurality of packages. Even more particularly the invention relates to a one-piece wrapper made into a package for holding containers which can be easily separated into individual smaller packages upon delivery to the retailer, lowering the cost of manufacturing, warehousing, transportation, storage and delivery of containers.

Several different multi-unit packaging systems have been developed for the marketing of a number of packaged products, for example, bottled and canned beverages and other liquid products. Currently, most bottle or can containers are shipped in units of six, generally referred to as the six pack package. Four six-packs are normally placed together in a paper tray for shipment from the manufacturer to the retail outlet. At present the six beverage containers in a six-pack are typically held together by a piece of plastic having six circular apertures or by a simple wrap-around paperboard package such as that disclosed in U.S. Pat. No. 4,566,593 issued Jan. 28, 1986 to Muller. When a paper tray of six-packs arrives at the retail outlet, the paper tray must be discarded if the containers are to be sold as six-packs. If the retailer would prefer to have two six-packs packaged together as a twelve-pack unit, or would prefer to sell six-packs individually, the manufacturer must establish a different manufacturing line to produce six-packs, twelve-packs, and twenty four packs, and all manufacturing, warehousing, transportation, storage and delivery between the manufacturer and the retailer must store the six-packs, twelve-packs, and twenty four-packs separately.

U.S Pat. No. 3,759,378, issued Sep. 18, 1973 to Werth, attempts to alleviate this problem by providing a container that will hold four six-packs. The container is comprised of a wrapper which wraps around all four six-packs, and has a tear-strip which allows the wrapper to be separated into two twelve-packs. A primary disadvantage of this type of package is that the tear-strip completely surrounds the entire carton, and therefore, the carton must be turned a full 360 degrees in order to remove the tear-strip.

U.S. Pat. No. 3,942,631 issued Mar. 9, 1976 to Sutherland, et al, also addresses the problem of separating containers after they arrive at the retailer. This invention, however, primarily addresses changing the outer carton which contains the six-packs into a display case.

U.S. Pat. No. 4,415,082 issued Nov. 15, 1983 to Martin, partially addresses the problem of shipping multi-unit cartons, each of which contains a liquid. A tear-strip is provided to separate the cartons and the outer wrapper is then used as a handle.

U.S. Pat. No. 2,758,777 issued Aug. 14, 1956 to Dixon, partially address the problem of shipping multi-unit cartons. Dixon, however, uses nearly double the quantity of material to form the packages as conventional packaging and this excess material, as well as being costly, significantly complicates the forming machinery necessary to assemble the packages at high speeds. The Dixon package requires a band to hold the packages together, since without the band, the bottom of the packages would separate. Thus the band serves the same function as the tray used with most conventional packages, and has the same cost and disposal problems. Also, once the band is removed, the package can only be separated into four six-packs and cannot be separated into twelve packs. Furthermore, the perforations separating the cartons would be difficult to break unless they are cut, thus increasing the complexity of the separation operation. Perforations are not very effective in packaging made of the heavy material necessary to hold twenty-four containers.

European Patent Application 0,029,365 Filed Nov. 14, 1980 addresses the problem of holding the containers in a package by forming apertures in the top of the package, but does not address the problem of multi-unit shipping.

None of the above described inventions address the primary problems associated with the current packaging methods. First, is the problem of requiring separate manufacturing lines and separate packaging, warehousing, transportation, storage and delivery in order to produce six-pack, twelve-pack and twenty four-pack packages. A second problem is the tray used to contain four six-packs: these trays are costly to produce, require added handling, produce unnecessary waste, and become a disposal problem. A third problem is having to dispose of the plastic six-pack carriers. Furthermore, none of the packaging methods described in the above patents address the easy separation of a package into four six-packs or two twelve-packs. There is need in the art then for a versatile package which is manufactured as a one-piece wrapper that holds a plurality of containers together as a single unit, and later can be separated by the retailer into two twelve-packs, or further separated by the retailer into four six-packs. There is also a need in the art for such a packaging method that would eliminate the cost, waste and disposal problems associated with the tray and plastic six-pack carriers presently used. There is further need in the art for a package wherein the wrapper that surrounds the twenty four-pack is the same wrapper surrounding the twelve-packs and six-packs, eliminating the need for any additional wrappers. Yet another need is for such a wrapper that eliminates or minimizes the use of perforations, because of the difficulty of separating heavy cardboard packages at the perforations.

SUMMARY OF THE INVENTION

It is an aspect of the present invention to provide a package formed from a single piece of material, capable of containing a plurality of containers such as cans or bottles.

It is another aspect of the invention to provide such a system that allows a manufacturer to eliminate separate manufacturing production for twenty four-pack, twelve-pack and six-pack packages.

Another aspect of the invention is to eliminate the need for separate warehousing, transportation, storage and delivery of twenty four-pack, six-pack and twelve-pack packages.

A further aspect of the invention is to provide such a package that can be conveniently separated into two twelve-pack containers or further separated conveniently into four six-packs.

A still further aspect of the invention is to provide such a container which is formed from a piece of carrier board, recycled paper or other recycled materials, or from A, B, C, D, E, or Super E flute paper corrugated material.

The above and other aspects of the invention are accomplished with a package formed from a wrapper, typically made of a single piece of carrier board, that is folded around a desired number of containers such as twenty-four cans or bottles. The top and bottom of the package has cuts or perforations that partially separate the package into two twelve-packs. Each side of the package has at least one tear-strip that will complete the separation of the package into two twelve-packs, for example, without having to lift and rotate the package. If desired, the top and bottom of the package could each be provided with two cuts and each side of the package provided with two tear-strips, so that the package can be separated into three eight-packs. The top or bottom of the package can also be provided with tear-strips to allow the two twelve-packs to be separated into four six-packs. The wrapper is folded in such a manner that the two six-packs of each of the two twelve-packs can be separated by a center divider in the wrapper. This divider can have a perforated top end which is aligned with the tear-strips of the package top or bottom. The two sides of the divider which are located on opposite sides of the perforation, are held together by an adhesive which allows the six-packs to be separated. The combination of the tear-strips, divider, and the adhesive hold the container into a twenty four-pack, while easily allowing it to be divided into two twelve-packs, or four six-packs.

Alternative embodiments of the package formed from a wrapper as described above, include: providing the divider with a foldover flap at the perforated top end or merely folding the divider once so that its perforated top end comes to a point; providing the wrapper with a container-retaining panel that has a plurality of openings sized so that containers can project therethrough; providing the wrapper with a first and second separator fold that has at least one cutout to assist in retaining a container; or providing the foldover flap with a first and second ear located on opposite sides of the divider perforation.

Another characterization of the invention is a method of packaging a plurality of containers, for example twenty-four, as a single unit.

BRIEF DESCRIPTION OF THE DRAWINGS

The above and other objects, features, and advantages of the invention will be better understood by reading the following more particular description of the invention, presented in conjunction with the following drawings, wherein.

DESCRIPTION OF THE PREFERRED EMBODIMENT

The following description is of the best presently contemplated mode of carrying out the present invention. This description is not to be taken in a limiting sense but is made merely for the purpose of describing the general principles of the invention. The scope of the invention should be determined by referencing the appended claims.

Figure 1:
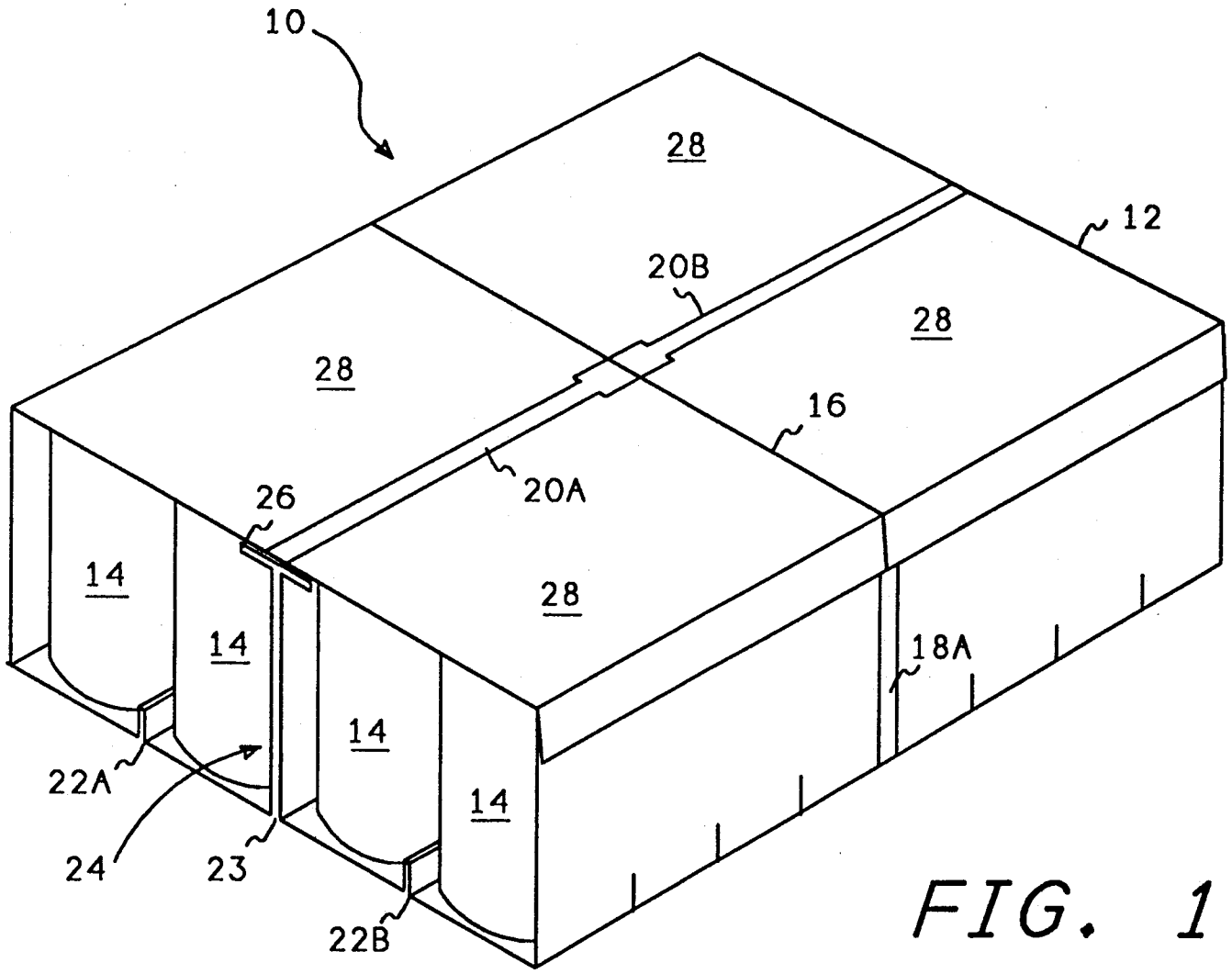
FIG. 1 shows a perspective view of the detachable multi-unit package.

FIG. 1 shows a perspective view of the multi-unit package of the present invention. Referring now to FIG. 1, a package 10 is comprised of a one-piece wrapper 12 which wraps around and contains twenty-four cans or bottles 14, arranged in four rows of six. The wrapper 12 has a cut 16 in the package top 28 and a cut (not shown in FIG. 11) in the package bottom which, in combination with a pair of tear-strips 18A and 18B (not shown in FIG. 1), allow the twenty four-pack to be split into two twelve-packs. Cut 16 need not extend completely across top 28, but preferably should extend far enough to weaken the line between tear-strips 18A and 18B so the package can be separated with relative ease. Cut 16 and the portion of cut 50 located on the package bottom (shown in FIG. 5) together with tear-strips 18A and 18B, form a wrap-around dimension of the package. A second pair of tear strips 20A and 20B allow the two twelve-packs to be split into four six-packs. A pair of folds 22A and 22B, formed as part of the one-piece wrapper 12, separate the rows of cans or bottles to provide cushioning and to assist in keeping the cans or bottles inside the wrapper 12. A center divider 24, also formed as part of the one-piece wrapper 12 by making a fold open at 23, contains a foldover flap 26 located at the top end of the divider 24. The foldover 26 allows the divider 24 to be glued to the top 28 of the wrapper 12, as illustrated in FIG. 4. The foldover 26 (shown in greater detail in FIG. 3) contains a perforation at its center to allow a twelve-pack to be easily separated into two six-packs once tear-strips 20A and 20B are removed. The divider 24, as part of being formed from the one-piece wrapper 12, contains two side pieces which are attached together. The attachment means used to hold the side pieces together is of a type that will allow the side pieces to be pulled apart with relative ease to form the six-packs.

In another embodiment (not shown), the center divider 24 does not extend to contact the top 28 but, instead, is the same height as the folds 22A and 22B.

Figure 2:
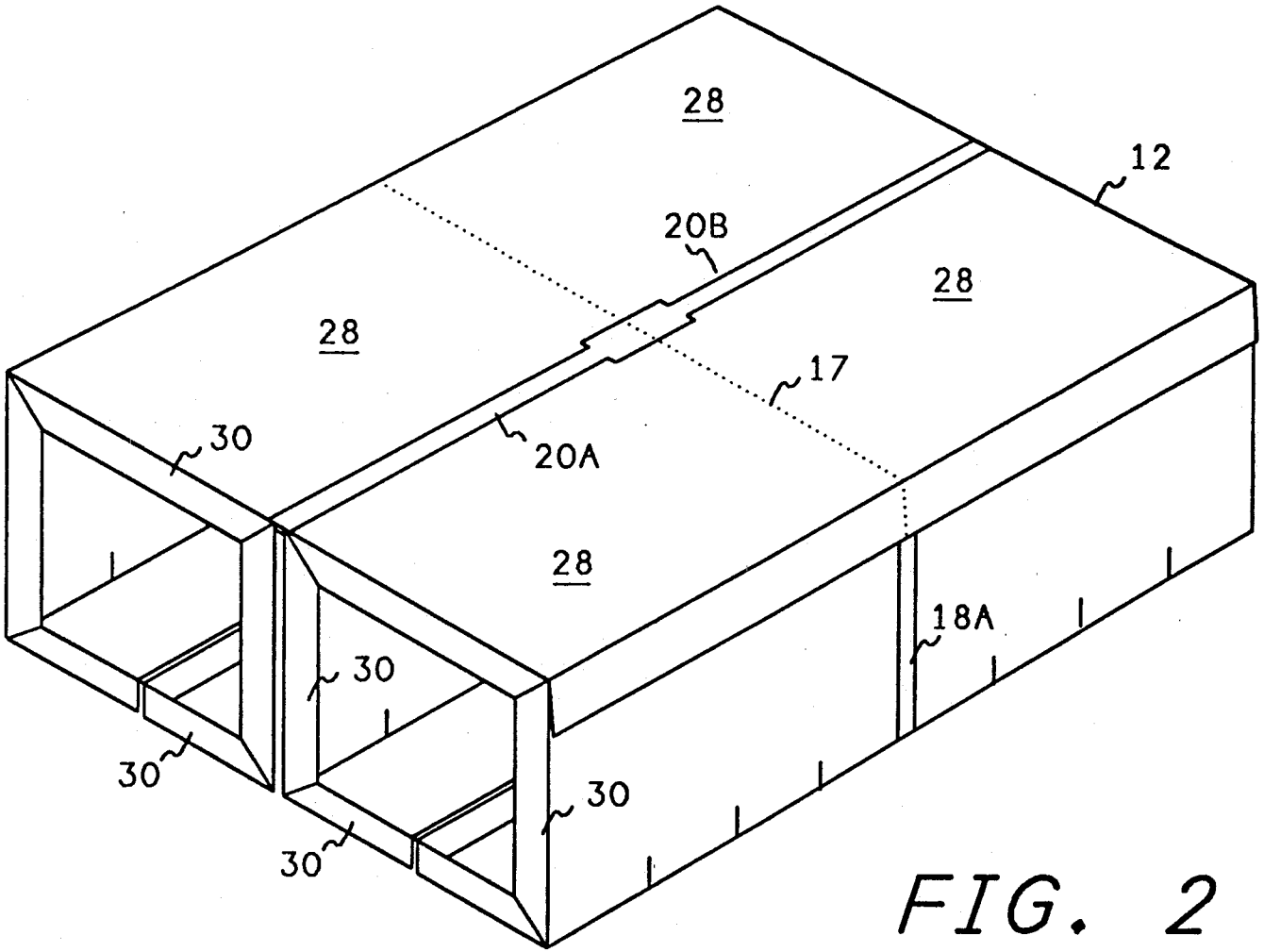
FIG. 2 shows an alternative embodiment of the package showing end flaps.

The package of the invention is easily adaptable for (1) holding greater or less than twenty-four containers, and (2) producing sub-units of other than six containers such as eight-packs or four-packs. A divider (such as 24 in FIG. 1 or 66 in FIG. 8) need not be centrally located, but may be located between any desired subset of the total number of containers held in the package. For example, in a twenty-four-pack package, two dividers 24 could be positioned to form a six-pack (one row of six) on either side of a centrally located twelve-pack (two rows of six). One can see that the package and method of packaging containers of the invention is very adaptable for producing a variety of desired package combinations. FIG. 2 shows a second embodiment of the invention. Referring now to FIG. 2, a series of end-flaps 30 may be incorporated into the package along its side edges (as shown also in FIG. 6) to assist in retaining the cans or bottles inside the wrapper 12. Perforation 17 in top 28 extends along a line connecting 18A and 18B (not shown in FIG. 2). Once tear-strips 18A and 18B are removed, the package can be torn apart along perforations 17 and (shown in FIG. 6).

Figure 3:
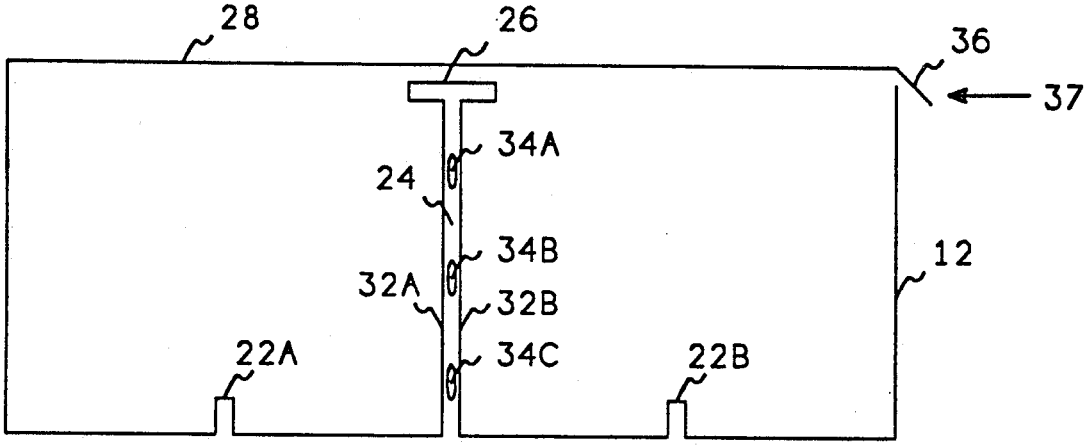
FIG. 3 shows an end view of the package.
Figure 4:
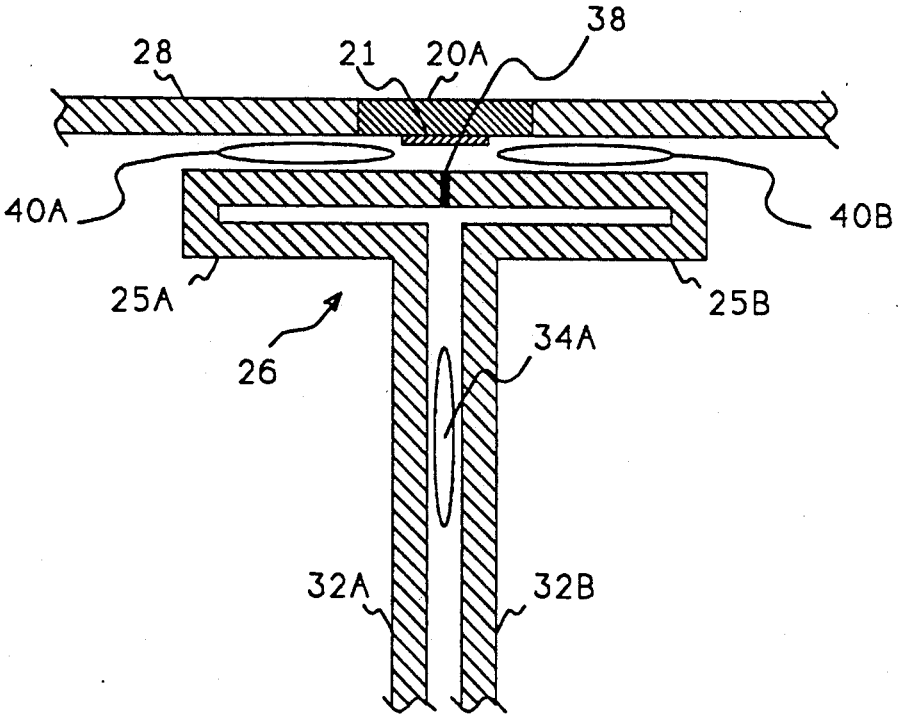
FIG. 4 shows an end view of the connection between the center divider and the top of the package.

FIG. 3 shows an end view of the package 10. Referring now to FIG. 3, the one-piece wrapper 12 is shown having the folds 22A and 22B and the center divider 24. The center divider 24 is shown having two side pieces 32A and 32B which form the sides of two six-packs after the unit is separated. Beads of adhesive 34A, 34B, and 34C extend sufficiently far along divider 24 to hold the two six-packs together until separation is desired. A flap 36 located at trailing edge portion 37 is used to secure the wrapper around the containers after the twenty-four cans or bottles have been wrapped.

Other methods can be used to hold the package together in place of the adhesive 34A, 34B, and 34C. For example, ultra sonic welding, laser welding, flame welding, tape, staples, or rivets could be used.

FIG. 4 shows a detailed view of the foldover flap 26 as it makes contact with the package top 28. Referring now to FIG. 4, center divider sides 32A and 32B are folded to produce the foldover flap 26. At the center of the foldover flap 26 is a perforation 38 which extends sufficiently far along the length of the divider to allow the package to be split into six-packs and is aligned with the second pair of tear-strips 20A and 20B. Foldover flap 26 has a first and second ear 25A and 25B located on opposite sides of perforation 38. The tear-strip 20A is shown centered over the perforation 38. The ears 25A and 25B of foldover flap 26 are attached to the top 28 of the wrapper by a pair of beads of adhesive 40A and 40B which extend sufficiently far along divider 24 to hold the six-pack sub-units together. After the tear-strips 20A and 20B are removed from the package, the divider is separated at perforation 38 and the adhesive beads 34A, 34B, and 34C can be pulled away to allow the twelve-pack to be separated into two six-packs. A tear-strip such as 18A, 18B, 20A, 20B, 73A and 73B of FIG. 10, and 83A and 83B of FIG. 11 can take many suitable forms such as (1) two parallel perforations in the wrapper with or without pull string 21 of FIG. 4 to aid in separating the tear-strip from the wrapper, or (2) an adhesive-backed strip of flexible, strong plastic placed over a cut in the wrapper where the tear-strip is to be located.

Figure 5:
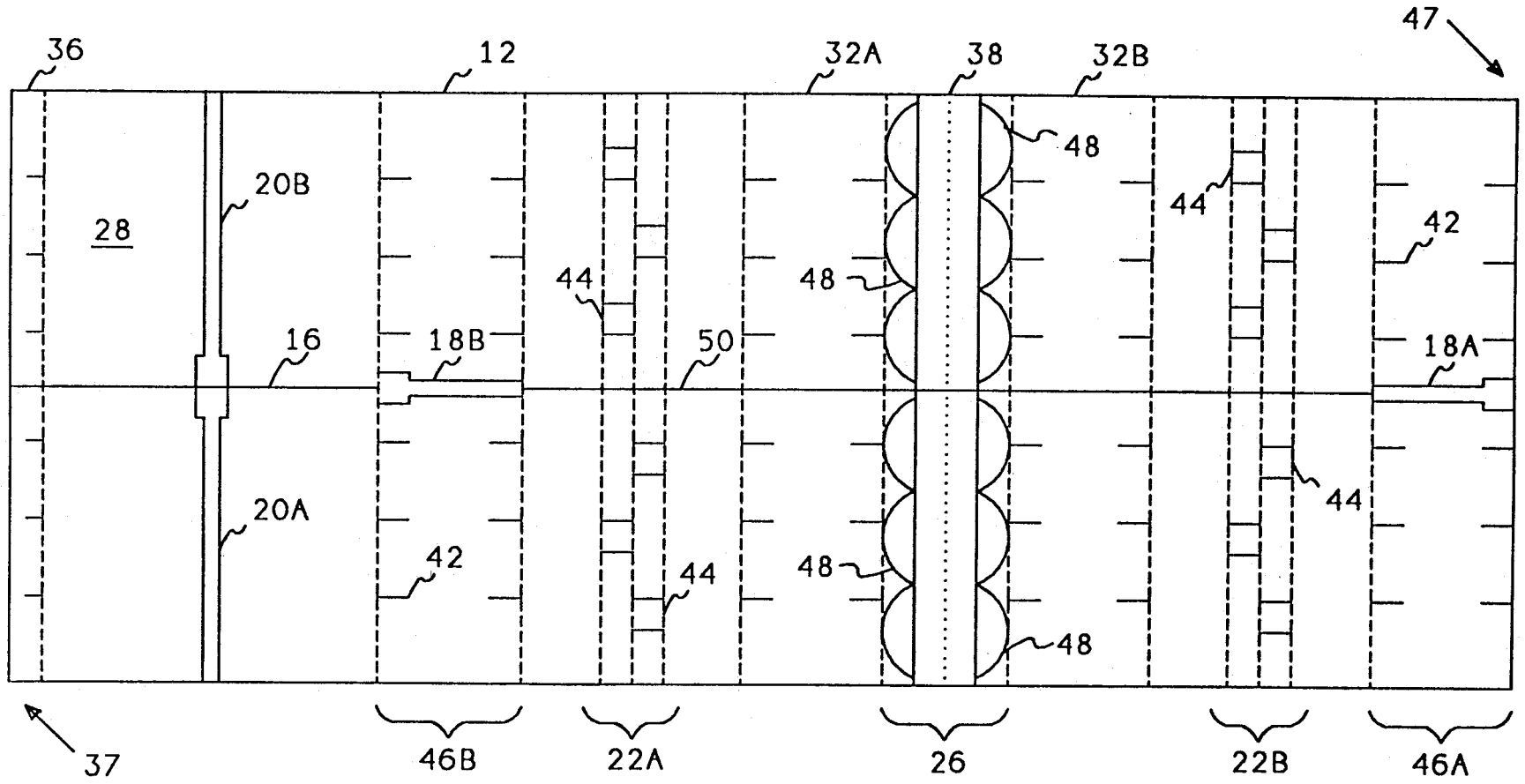
FIG. 5 shows a layout view of the one-piece construction used to form the package.

FIG. 5 shows a lay-out view of the wrapper 12. Referring now to FIG. 5, the wrapper 12 includes a leading edge portion 47 and on end flap 36 located at trailing edge portion 37. The top section 28 is shown having the tear-strips 20A and 20B, as well as the cut 16. Side tear-strips 18A and 18B are shown in the side sections 46A and 46B. Folds 22A and 22B are shown having cutouts 44 which assist in retaining the cans or bottles in the package 10. Divider side pieces 32A and 32B, as well as side pieces 46A and 46B contain slits 42 which also assist in retaining the cans or bottles in the container 10. Semi-circular scallops 48 formed into the first and second ears of foldover flap 26 assist in retaining the cans or bottles inside the carton. Scallops 48 are cut to fit the containers. A cut 50, located in the bottom of the package along a line connecting first-pair tear-strips 18A and 18B, is aligned with cut 16 located in the top of the package. Cuts 50, 16 sufficiently weaken the package to allow it to be separated into two twelve-packs. Thus, preferably the tear-strips 18A and 18B are the primary means used to hold the two twelve-packs together. This is advantageous, because the tear-strips 18A and 18B can be removed without turning the carton over, unlike prior art devices.

Cuts 16 and 50 together with tear-strips 18A and 18B form a lengthwise dimension of the wrapper extending from leading edge portion 47 to trailing edge portion 37.

The method of packaging the containers 14 of FIGS. 1-5 includes: providing wrapper 12 with tear-strips 18A and 18B spaced apart along a first-pair line (see cut 50 of FIG. 5) between tear-strips 18A and 18B; cutting a portion of the wrapper 12 along the first-pair line at 50 in FIG. 5; and wrapping the wrapper 12 around containers 14 and securing at least a portion of trailing edge portion 37 in FIG. 5 to the wrapper so that tear-strips 18A and 18B are located on package side pieces 46A and 46B. A portion of cut 50 will be located on the package bottom. The method of packaging can further include cutting wrapper 12 between tear-strip 18B and trailing edge portion 37 to further weaken the wrapper along the first-pair line. This forms cut 16 located on package top 28 as shown in FIGS. 1 and 5.

Figure 6:
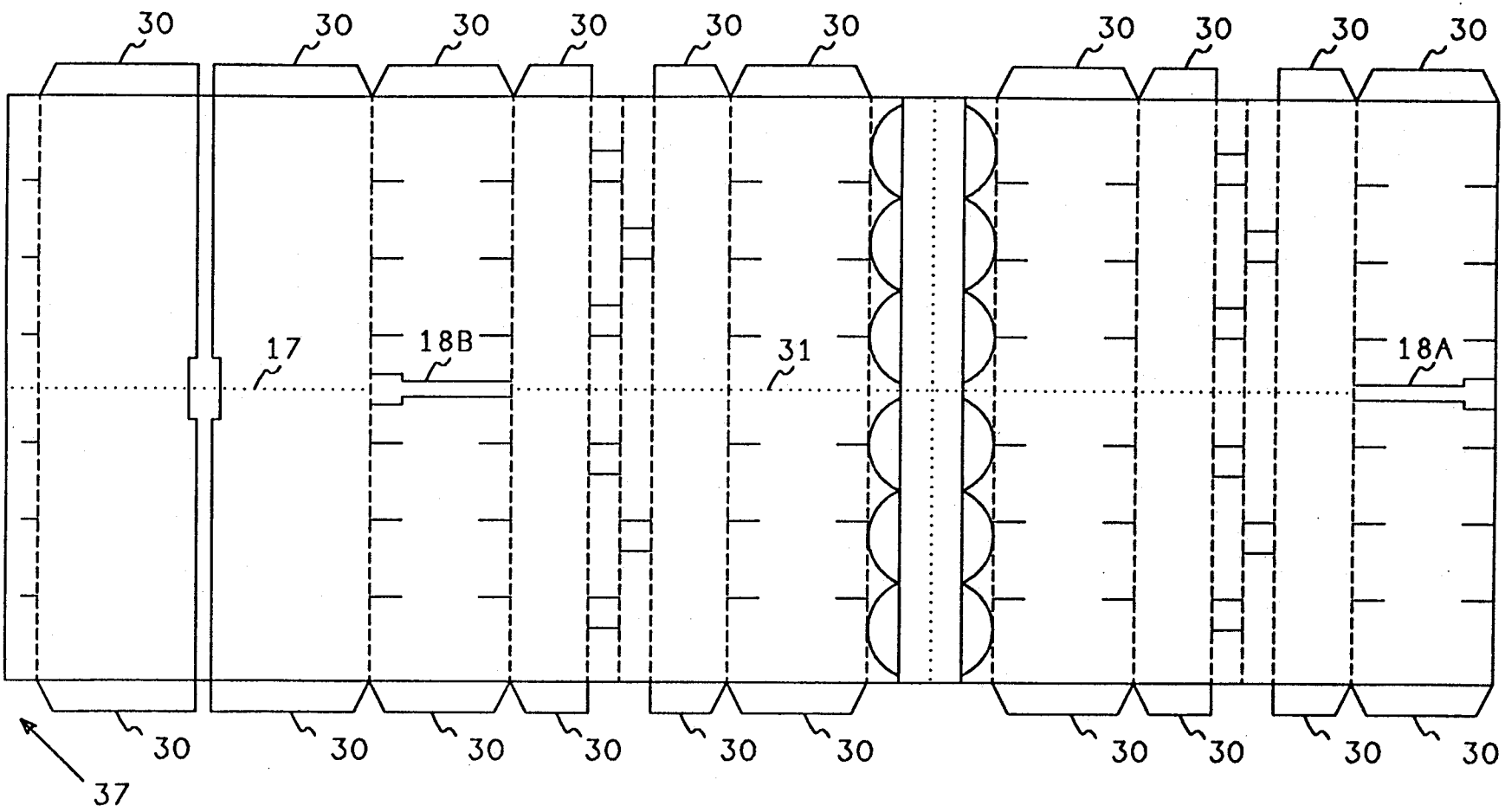
FIG. 6 shows a layout view of the alternative embodiment.

FIG. 6 shows a lay-out view of the alternative embodiment of FIG. 2. Referring now to FIG. 6, the lay-out is similar to the lay-out of FIG. 5, with the addition of the series of end flaps 30 which assist in retaining the cans or bottles inside the package 10. Alternatively, perforation 31 which extends along a line connecting tear-strips 18A and 18B could be a combination of a perforation in the portion of the wrapper that becomes the package bottom plus cuts along the same line. It is only important that the line connecting tear-strips 18A and 18B sufficiently weaken the package to allow it to be separated along that line with relative ease.

Figure 7:
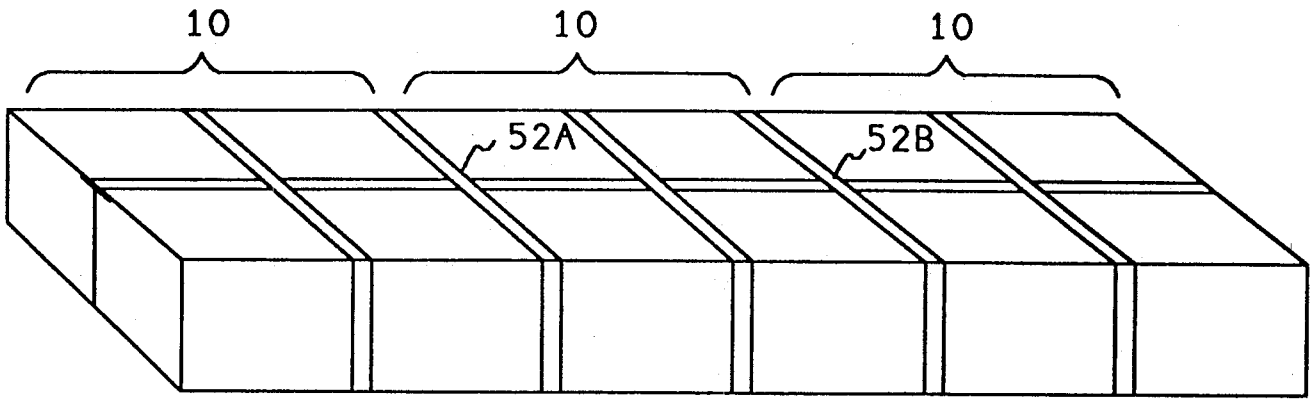
FIG. 7 shows a plurality of packages connected together.

FIG. 7 shows three of the packages 10 integrated together end to end to form a seventy two-pack. This package is formed of a one-piece wrapper that integrates three packages 10 by adding third and fourth tear-strips or a third and fourth combination of tear-strips plus cuts (similar to the combination in FIG. 1 of tear-strips 18A and 18B plus cuts 16 and 50) as shown at 52A and 52B which can be used to separate the unit into three twenty four-packs.

Figure 8:
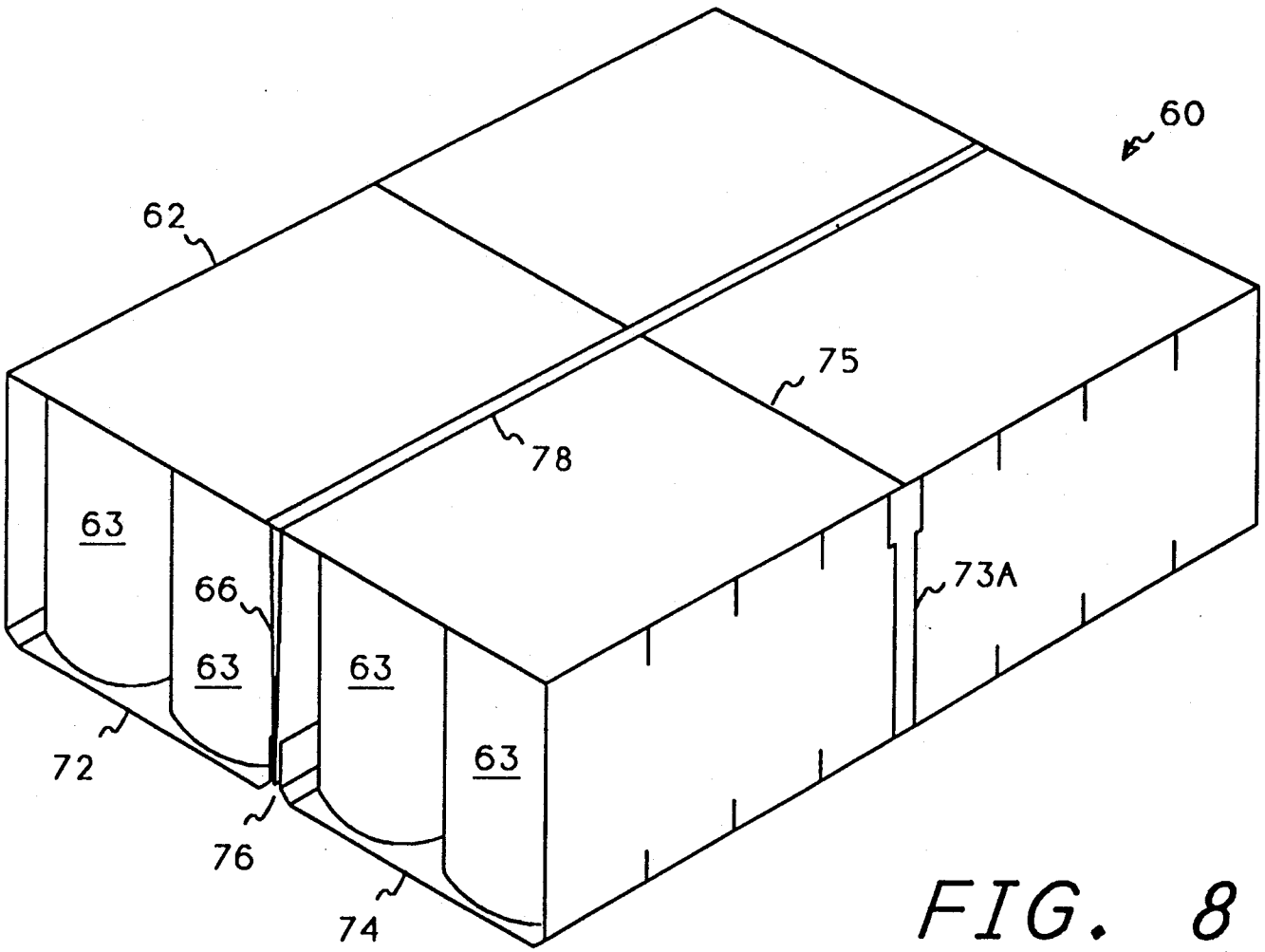
FIG. 8 shows a perspective view of a second alternative embodiment of the invention.
Figure 10:
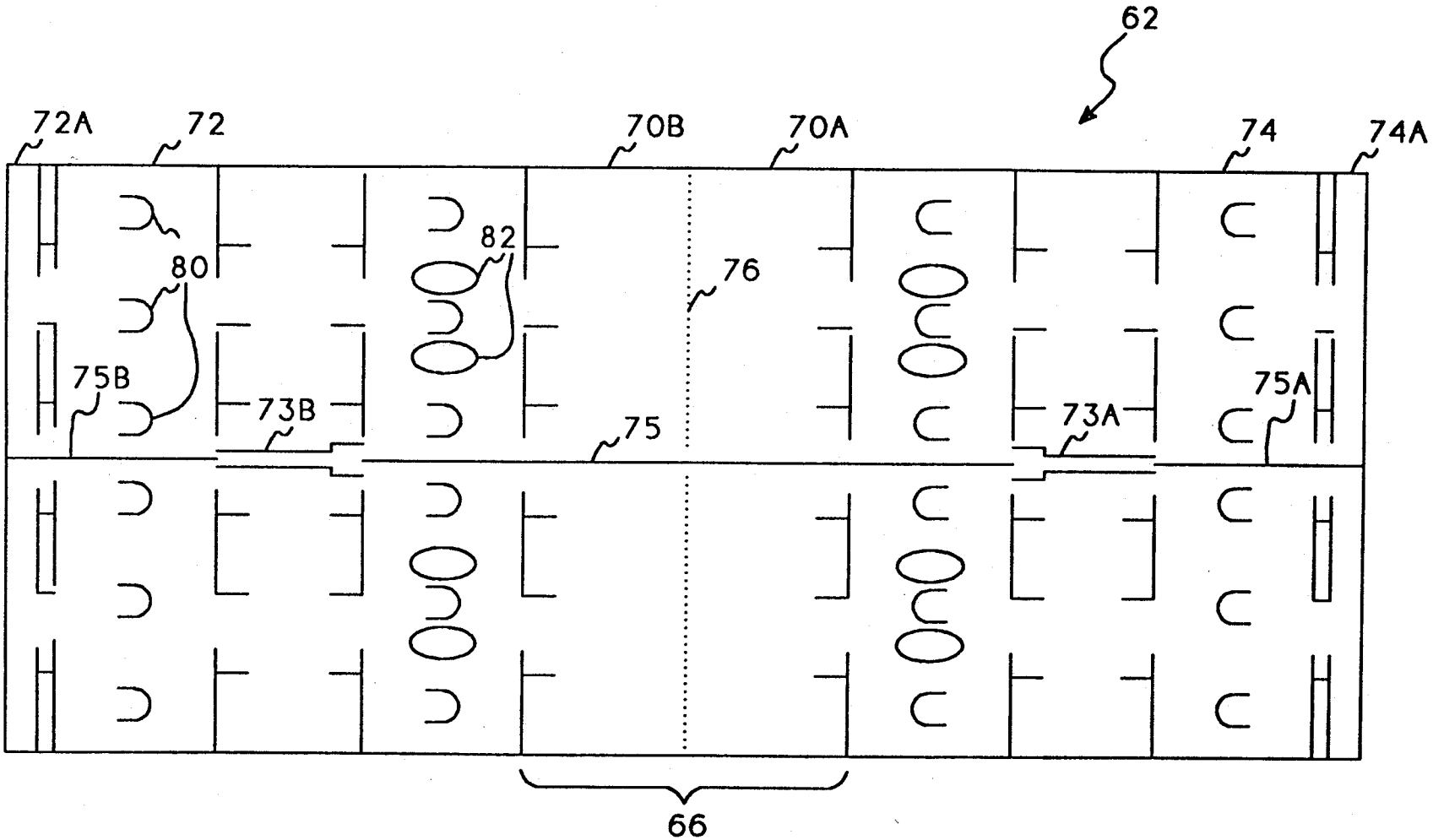
FIG. 10 shows a layout view of the second alternative embodiment.

FIG. 8 shows a perspective view of an alternative embodiment of the package. Referring now to FIG. 8, a package 60 is comprised of a one-piece wrapper 62 which wraps around and contains twenty-four cans or bottles 63, which are arranged in four rows of six cans or bottles. The wrapper 62 has tear-strips 73A and 73B (as shown in FIG. 10) and cuts 75, 75A and 75B (FIG. 10) which allow the twenty-four-pack to be split into two twelve-packs. A center divider 66 is also formed as part of the one-piece wrapper 62. The center divider 66 contains a perforation at its top end 76 to allow each twelve-pack to be easily separated into two six-packs. The divider 66, as part of being formed from the one-piece wrapper 62, contains two side pieces which are attached together. The attachment means used to hold the side pieces together is of a type that will allow the side pieces to be pulled apart with relative ease to form the six-packs. A strip of tape 78 optionally can be used for increased resistance to premature separation.

Figure 9:
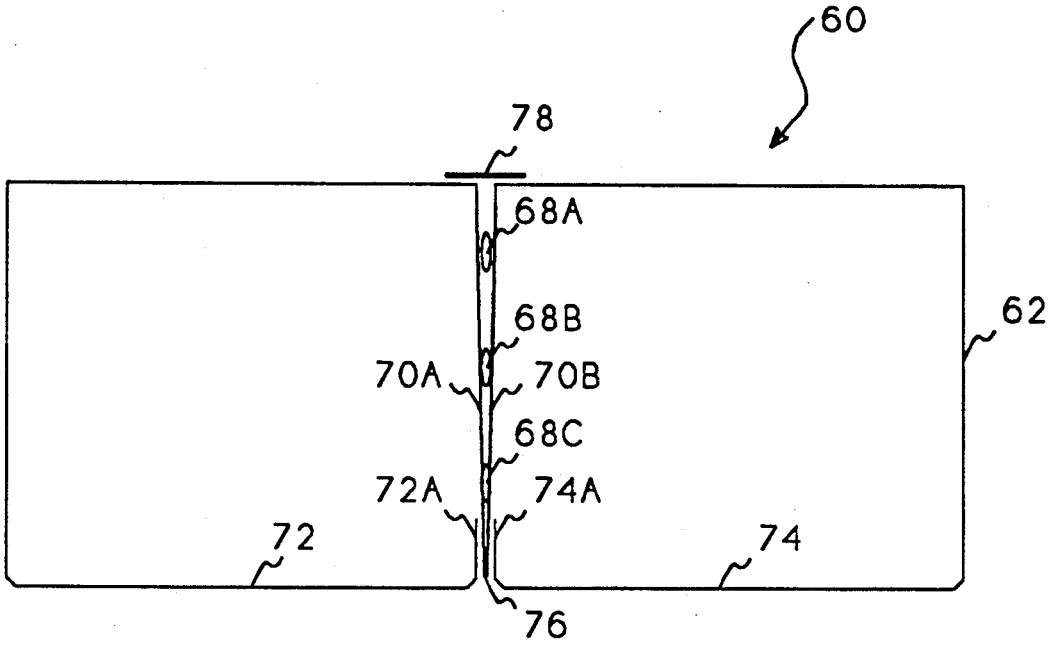
FIG. 9 shows an end view of the second alternative embodiment.

FIG. 9 shows an end view of the package 60. Referring now to FIG. 9, the one-piece wrapper 62 is shown with the center divider 66 having two side pieces 70A and 70B which form the sides of six-packs after the unit is separated. Beads of adhesive 68A, 68B, and 68C or other suitable attachment means extending sufficiently far along divider 66, hold the two six-packs together until separation is desired. The bottom of the container is formed by two flaps 72 and 74, which have trailing edge portion 72A and leading edge portion 74A that are secured by suitable means to the center divider 66 to form a closed container. Center divider 66 is perforated along its top end (shown as dotted line 76 in FIG. 10), so that the two six packs can be easily separated.

The two flaps 72 and 74 may be folded to provide a "v" shaped opening at the center bottom of the package. This also requires that divider 66 be shortened so that it does not extend into the opening. This "v" shaped opening allows the package halves to be more easily grasped for package separation. When used in this manner, the package may be inverted so that the "v" shaped opening is in the top of the package.

Other methods can be used to hold the packages together, in place of the adhesive 68A, 68B, and 68C. For example, ultra sonic welding, laser welding, flame welding, tape, staples, or rivets could be used.

FIG. 10 shows a layout view of the wrapper 62. Referring now to FIG. 10, each of the sections of the wrapper described above is shown. Partial cutouts 80 are folded up at approximately 90 degrees to the package top or bottom in which they lie, so that partial cutout 80 projections are formed and they are located between the cans or bottles to help keep the cans inside the container. Partial cutouts 82 serve as finger holes so that a person can hold a six-pack.

Figure 11:
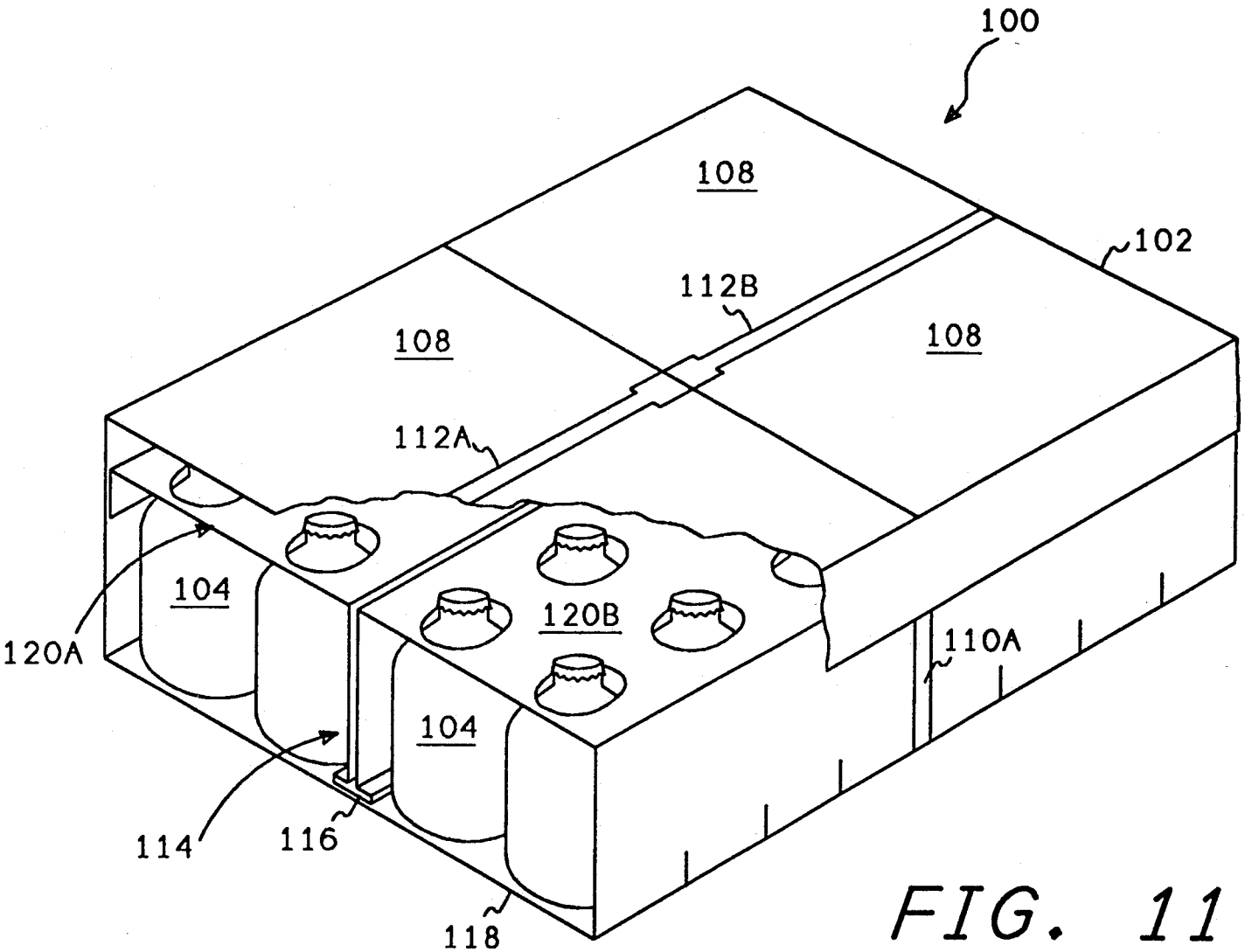
FIG. 11 shows an alternative embodiment of the invention having a container retaining panel.

FIG. 11 illustrates another alternative embodiment wherein cutouts are provided in a container retaining panel to assist in retaining containers within a package. Referring now to FIG. 11, a package 100 is comprised of a one-piece wrapper 102 which wraps around and contains twenty-four cans or bottles 104, arranged in four rows of six. The wrapper 102 has a cut 106 in the package top 108 and a cut (not shown in FIG. 11) in the package bottom which, in combination with a pair of tear-strips 110A and 110B (not shown in FIG. 11), allow the twenty four-pack to be split into two twelve-packs. Cut 106 need not extend completely across top 108, but preferably should extend far enough to weaken the line between tear-strips 110A and 110B so the package can be separated with relative ease. Cut 106 and the portion of the cut located on the package bottom (not shown in FIG. 11) together with tear-strips 110A and 110B, form a wrap-around dimension of the package. A second pair of tear strips 112A and 112B allow the two twelve-packs to be split into four six-packs. A center divider 114, also formed as part of the one-piece wrapper 102, contains a foldover flap 116 located at the bottom end of the divider 114. The foldover 116 allows the divider 114 to be glued to the bottom 118 of the wrapper 102. The bottom 118 contains a cut or perforation (not shown in the figure) at the glue point. The divider 114, as part of being formed from the one-piece wrapper 102, contains two side pieces which are attached together. The attachment means used to hold the side pieces together is of a type that will allow the side pieces to be pulled apart with relative ease to form the six-packs.

A pair of container retaining panels 120A and 120B contain a plurality of cutouts 122, one for each container 104, which allow the top of a container 104 to protrude therethrough while fitting snugly around the container 104. These cutouts assist in retaining the containers 104 in the package 100.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the spirit and scope of the present invention. The disclosures and the description herein are intended to be illustrative and are not in any sense limiting of the invention, more preferably defined in scope by the following claims.

What is claimed is:

1. A package for holding a plurality of containers as a single unit, comprising:

a wrapper having a leading and trailing edge portion, a first and second package side, a package top and bottom, and a wrap-around dimension extending from said trailing edge portion around said sides, top, and bottom;

means for securing at least a part of said trailing edge portion to another portion of said wrapper;

a divider formed of a portion of said wrapper, said divider being located between at least a first and second container of the plurality of containers, and oriented in a direction generally perpendicular to said wrap-around dimension, and wherein said divider comprises a first side piece and a second side piece in proximity thereto;

a foldover flap extending substantially the length of said divider between said first and second side pieces;

a perforation in said foldover flap;

a first tear strip on said first side and a second tear strip on said second side, said first and second tear strips oriented in a direction generally along said wrap-around dimension;

a first cut in said package top extending substantially between a top end of said first tear strip and a top end of said second tear strip;

a second cut in said package bottom extending substantially between a bottom end of said first tear strip and a bottom end of said second tear strip.

2. The package of claim 1 further comprising:

a container-retaining panel formed of a portion of said wrapper in proximity with said leading edge portion, said panel comprising a plurality of openings each sized so that one of the plurality of containers can project therethrough; and means for securing at least a portion of said leading edge portion to said first package side.

3. The package of claim 1 further comprising a third and fourth tear strip on said package top located along a second-pair line in a direction generally perpendicular to said wrap-around dimension.

4. The package of claim 3 wherein said divider is located substantially in line with said second-pair line.

5. The package of claim 4 further comprising:

a first separator fold of said wrapper located between at least said first container and a third container of the plurality of containers; and a second separator fold of said wrapper located between at least said second container and a fourth container of the plurality of containers.

6. The package of claim 5 wherein each of said first and second separator folds further comprises at least one cutout to assist in retaining one of the plurality of containers in said package.

7. A package for holding a plurality of containers as a single unit, comprising:

a wrapper having a leading and trailing edge portion, a first and second package slide, a package top and bottom, and a wrap-around dimension extending from said trailing edge portion around said sides, top, and bottom;

means for securing at least a portion of said trailing edge portion to another portion of said wrapper; and a divider formed of a portion of said wrapper comprising a first side piece, a second side piece in proximity thereto, and a foldover flap comprising a perforation extending substantially the length of said divider between said first and second side piece, said divider located between at least a first and second container of the plurality of containers and oriented in a direction generally perpendicular to said wrap-around dimension.

8. The package of claim 7 wherein said foldover flap further comprises a first ear between said perforation and said first side piece, and a second ear between said perforation and said second side piece; and wherein said package further comprises means for securing said first and second ears to said wrapper.

9. The package of claim 8 wherein each of said first and second ears further comprises at least one semi-circular scallop to assist in retaining one of the plurality of containers in said package.

10. The package of claim 7 further comprising:

a first tear strip on said first side and a second tear strip on said second side, said first and second tear strips oriented in a direction generally along said wrap-around dimension;

a first cut in said package top extending substantially between a top end of said first tear strip and a top end of said second tear strip; and a second cut in said package bottom extending substantially between a bottom end of said first tear strip and a bottom end of said second tear strip.

11. The package of claim 10 further comprising a third and fourth tear strip on said package top located along a second-pair line substantially in line with said divider perforation.

12. A package for holding a plurality of containers as a single unit, comprising:

a wrapper having a leading and trailing edge portion, a first and second package side, a package top and bottom, and a wrap-around dimension extending from said trailing edge portion around said sides, top, and bottom;

a divider formed of a portion of said wrapper comprising a first side piece attached to a second side piece, and a perforation extending substantially the length of said divider between said first and second side piece, said divider located between at least a first and second container of the plurality of containers and oriented in a direction generally perpendicular to said wrap-around dimension; and means for securing at least a portion of said leading and trailing edge portions to said divider on opposite sides of said perforation.

13. The package of claim 12 wherein said leading edge portion and said trailing edge portion are folded to form a "v" at the point of contact with said divider.

14. The package of claim 13 wherein said means for attaching comprises an adhesive.

15. The package of claim 13 wherein said means for securing comprises an adhesive.

16. A method of packaging a plurality of containers as a single unit, comprising the steps of:

providing a relatively planar wrapper having a leading and trailing edge portion, a lengthwise dimension extending from said leading edge portion to said trailing edge portion, and a first and second tear strip spaced apart and located along a first-pair line in a direction generally parallel to said length wise dimension;

forming a divider form said wrapper, locating said divider between a first and second of said containers, orienting said divider in a direction perpendicular to said lengthwise dimension, and forming said divider of a first side piece and a second side piece in proximity thereto;

perforating said divider, said perforation extending substantially the length of said divider between said first and second side pieces;

cutting a portion of said wrapper between said first and second tear strip along said first-pair line; and wrapping said wrapper around said plurality of containers and securing at least a portion of said trailing edge portion to another portion of said wrapper to form a package having a first and second side, a top, and a bottom, said first tear strip being located on said first side, and said second tear strip being located on said second side.

17. The method of claim 16 further comprising the step of cutting a portion of said wrapper between said first tear strip and said trailing edge portion along said first-pair line.

18. The method of claim 16 further comprising the step of forming a first and second ear on opposite sides of said perforation to produce a foldover flap.

19. The method of claim 18 further comprising the step of securing said first and second ears to said wrapper.

20. The method of claim 16 wherein said step of securing at least a portion of said trailing edge portion to said wrapper comprises securing at least a portion of said trailing edge to said first side piece; and further comprising the step of securing at least a portion of said leading edge portion to said second side piece.

* * * * *